US008366923B1

(12) United States Patent
Happel

(10) Patent No.: US 8,366,923 B1
(45) Date of Patent: Feb. 5, 2013

(54) TELESCOPING POST SUPPORTS AND SLIDING LID SYSTEMS FOR FILTER BASKETS

(76) Inventor: Tom Happel, Cocoa, FL (US)

( * ) Notice: Subject to any disclaimer, the term of this patent is extended or adjusted under 35 U.S.C. 154(b) by 446 days.

(21) Appl. No.: 12/790,215

(22) Filed: May 28, 2010

Related U.S. Application Data

(63) Continuation-in-part of application No. 12/292,431, filed on Nov. 18, 2008, now Pat. No. 7,981,283, which is a continuation-in-part of application No. 12/315,820, filed on Dec. 8, 2008, now Pat. No. 7,846,327.

(60) Provisional application No. 61/003,566, filed on Nov. 19, 2007, provisional application No. 61/009,086, filed on Dec. 27, 2007.

(51) Int. Cl.
*E03F 5/06* (2006.01)
*C02F 1/00* (2006.01)

(52) U.S. Cl. ..... 210/170.03; 210/236; 210/250; 210/747.3

(58) Field of Classification Search ..... None
See application file for complete search history.

(56) References Cited

U.S. PATENT DOCUMENTS

| | | | | | |
|---|---|---|---|---|---|
| 122,209 | A | * | 12/1871 | Ashman et al. | 210/163 |
| 232,948 | A | | 10/1880 | Dernham | |
| 587,559 | A | | 8/1897 | Riley | |
| 664,945 | A | | 1/1901 | Guion | |
| 783,556 | A | * | 2/1905 | Van Buskirk | 210/163 |
| 809,201 | A | | 1/1906 | Lutz | |
| 1,060,338 | A | * | 4/1913 | Gschwind | 210/314 |
| 1,349,734 | A | * | 8/1920 | Riley | 210/155 |
| 2,102,310 | A | * | 12/1937 | Egan | 210/497.3 |
| 2,182,795 | A | | 12/1939 | Day | |
| 2,263,259 | A | * | 11/1941 | Boosey | 210/314 |
| 2,615,526 | A | | 10/1952 | Lane | |
| 2,796,988 | A | * | 6/1957 | Loffler | 210/135 |
| 3,091,339 | A | * | 5/1963 | Marra et al. | 210/232 |
| 3,282,430 | A | | 11/1966 | Kinne | |
| 4,189,386 | A | * | 2/1980 | Aman | 210/235 |
| 4,198,717 | A | * | 4/1980 | Kessel | 4/286 |
| 4,297,219 | A | * | 10/1981 | Kirk et al. | 210/669 |
| 4,689,145 | A | * | 8/1987 | Mathews et al. | 210/170.03 |
| 4,895,653 | A | * | 1/1990 | Cherochak | 210/400 |
| 5,034,122 | A | * | 7/1991 | Wiesemann | 210/162 |
| 5,037,541 | A | | 8/1991 | Ruey-Jang | |
| 5,069,781 | A | | 12/1991 | Wilkes | |
| 5,133,619 | A | * | 7/1992 | Murfae et al. | 404/4 |
| 5,232,587 | A | * | 8/1993 | Hegemier et al. | 210/162 |
| 5,284,580 | A | | 2/1994 | Shyh | |
| 5,372,714 | A | * | 12/1994 | Logue, Jr. | 210/164 |
| 5,397,464 | A | | 3/1995 | Hannon | |
| 5,403,474 | A | | 4/1995 | Emery | |
| 5,405,539 | A | | 4/1995 | Schneider | |
| 5,480,254 | A | | 1/1996 | Autry | |
| 5,486,287 | A | | 1/1996 | Murphy | |
| 5,535,554 | A | | 7/1996 | Harris | |
| 5,562,819 | A | | 10/1996 | Turner | |
| 5,575,925 | A | * | 11/1996 | Logue, Jr. | 210/747.3 |
| 5,632,889 | A | | 5/1997 | Tharp | |
| 5,643,445 | A | | 7/1997 | Billias | |
| 5,779,888 | A | * | 7/1998 | Bennett | 210/162 |
| 5,810,510 | A | | 9/1998 | Urriola | |
| 5,820,762 | A | | 10/1998 | Bamer | |

(Continued)

*Primary Examiner* — Robert James Popovics
(74) *Attorney, Agent, or Firm* — Brian S. Steinberger; Law Offices of Brian S. Steinberger, P.A.

(57) ABSTRACT

Devices, apparatus, systems and methods of using an adjustable filter basket on telescoping post supports to raise and lower the filter basket so as to adjust the position of the inlet chute for different ground water levels in storm water treatment systems, along with horizontal slidable lids in tracks on the basket that allow access to the inside of the basket in vaults having ceilings close to the top of the baskets. A single winch point or floats can be used to raise and lower the filter basket on the telescopic post supports.

11 Claims, 12 Drawing Sheets

U.S. PATENT DOCUMENTS 5,855,774 A * 1/1999 Boelter ..... 210/155
5,904,842 A 5/1999 Billias
5,980,740 A * 11/1999 Harms et al. ..... 210/162
5,985,157 A 11/1999 Leckner
6,077,448 A * 6/2000 Tran-Quoc-Nam et al. .. 210/790
6,086,756 A * 7/2000 Roy ..... 210/155
6,086,758 A * 7/2000 Schilling et al. ..... 210/164
6,106,706 A * 8/2000 Roy et al. ..... 210/99
6,106,707 A 8/2000 Morris
6,149,803 A * 11/2000 DiLoreto et al. ..... 210/164
6,178,565 B1 1/2001 Franco
6,190,545 B1 * 2/2001 Williamson ..... 210/155
6,200,484 B1 * 3/2001 McInnis ..... 210/693
6,231,758 B1 5/2001 Morris
6,270,663 B1 8/2001 Happel
6,287,459 B1 9/2001 Williamson
6,294,095 B1 * 9/2001 Lewis ..... 210/747.3
6,334,953 B1 * 1/2002 Singleton ..... 210/232
6,379,541 B1 * 4/2002 Nicholas ..... 210/155
6,428,692 B2 * 8/2002 Happel ..... 210/155
6,478,954 B1 * 11/2002 Turner et al. ..... 210/162
6,517,709 B1 * 2/2003 Cardwell et al. ..... 210/164
6,531,059 B1 * 3/2003 Morris et al. ..... 210/164
6,537,446 B1 * 3/2003 Sanguinetti ..... 210/163
6,551,023 B2 * 4/2003 Allard ..... 405/36
6,562,233 B1 * 5/2003 Schilling et al. ..... 210/164
6,651,825 B2 * 11/2003 Turner et al. ..... 210/483
6,666,974 B2 * 12/2003 Page ..... 210/747.3
6,668,390 B1 * 12/2003 Gonzalez ..... 4/291
6,733,665 B1 * 5/2004 Khalil ..... 210/122
6,797,161 B2 * 9/2004 Use et al. ..... 210/131
6,797,162 B2 * 9/2004 Happel ..... 210/163
6,800,195 B1 * 10/2004 Batten et al. ..... 210/138
6,824,677 B2 * 11/2004 Martinez ..... 210/97
6,866,153 B2 * 3/2005 Turner et al. ..... 210/483
6,872,029 B2 * 3/2005 Allard et al. ..... 405/36
6,884,343 B2 * 4/2005 Harris et al. ..... 210/163
6,936,163 B2 * 8/2005 Use et al. ..... 210/131
6,939,461 B2 * 9/2005 Use et al. ..... 210/131
6,951,607 B2 * 10/2005 Use et al. ..... 210/122
6,974,540 B1 * 12/2005 Fleischmann ..... 210/163
6,976,808 B2 * 12/2005 Allard ..... 405/36
6,986,621 B2 * 1/2006 Allard ..... 405/36
6,994,783 B2 * 2/2006 Use et al. ..... 210/131
6,998,039 B2 * 2/2006 Harris et al. ..... 210/164
7,011,743 B2 * 3/2006 Use et al. ..... 210/131
7,083,721 B2 * 8/2006 McClure et al. ..... 210/155
7,094,337 B2 * 8/2006 Williams et al. ..... 210/162
7,094,338 B2 * 8/2006 Morris et al. ..... 210/163
7,112,274 B1 * 9/2006 Sanguinetti ..... 210/163
7,128,832 B2 * 10/2006 Wade ..... 210/155
7,132,045 B1 * 11/2006 Trangsrud ..... 210/163
7,153,417 B2 * 12/2006 Happel ..... 210/122
7,156,987 B1 * 1/2007 Sanguinetti ..... 210/164
7,270,747 B2 9/2007 Happel
7,282,142 B2 * 10/2007 Kraft ..... 210/170.03
7,288,188 B2 * 10/2007 Al-Assfour ..... 210/164
7,294,256 B2 * 11/2007 Happel et al. ..... 210/155
7,309,420 B1 * 12/2007 Trangsrud ..... 210/163
7,396,471 B2 * 7/2008 Wimberger ..... 210/747.3
7,488,414 B2 * 2/2009 Wimberger ..... 210/163
7,494,585 B2 * 2/2009 Nino ..... 210/170.03
7,524,414 B1 * 4/2009 Barragan ..... 210/163
7,658,857 B2 * 2/2010 Wacome ..... 210/747.3
7,662,280 B1 * 2/2010 Cooney ..... 210/164
7,771,591 B2 * 8/2010 Lucas ..... 210/163
7,815,800 B2 * 10/2010 Komatsu ..... 210/232
7,846,327 B2 * 12/2010 Happel et al. ..... 210/155
7,883,620 B2 * 2/2011 Owen ..... 210/86
7,981,283 B2 * 7/2011 Happel et al. ..... 210/162
7,981,300 B2 * 7/2011 Wacome ..... 210/747.3
8,017,006 B2 * 9/2011 Lopez ..... 210/163
8,034,234 B2 * 10/2011 Happel ..... 210/121
8,034,236 B1 * 10/2011 Happel ..... 210/162
8,034,237 B2 * 10/2011 Happel et al. ..... 210/170.03
8,038,879 B2 * 10/2011 Kraft ..... 210/340
8,083,937 B2 * 12/2011 Happel ..... 210/122
8,142,666 B1 * 3/2012 Happel ..... 210/747.2
8,221,632 B2 * 7/2012 McInnis et al. ..... 210/747.3
8,231,780 B2 * 7/2012 Happel ..... 210/122
2001/0047954 A1 * 12/2001 Happel ..... 210/155
2003/0121846 A1 * 7/2003 Use et al. ..... 210/521
2003/0132150 A1 * 7/2003 Happel ..... 210/163
2003/0136717 A1 * 7/2003 Tseng ..... 210/163
2003/0175079 A1 * 9/2003 Happel et al. ..... 405/46
2004/0065601 A1 * 4/2004 Martinez ..... 210/97
2004/0226869 A1 * 11/2004 McClure et al. ..... 210/163
2005/0051499 A1 * 3/2005 Nino ..... 210/747
2005/0069386 A1 * 3/2005 Happel et al. ..... 405/40
2005/0183997 A1 * 8/2005 Happel et al. ..... 210/163
2005/0218049 A1 * 10/2005 Happel ..... 210/163
2006/0163130 A1 * 7/2006 Happel et al. ..... 210/163
2006/0201860 A1 * 9/2006 Happel et al. ..... 210/162
2009/0114579 A1 * 5/2009 Dyer ..... 210/155
2009/0134081 A1 5/2009 Happel
2009/0166279 A1 7/2009 Happel
2010/0032363 A1 * 2/2010 Happel ..... 210/242.1
2010/0078370 A1 * 4/2010 Happel ..... 210/122
2011/0168612 A1 * 7/2011 Happel ..... 210/122
2011/0278237 A1 * 11/2011 McInnis ..... 210/767

* cited by examiner 10
20
30
40
50
70
80
90
100
130
140
150
160
180
190
200
210
240

Fig.14A
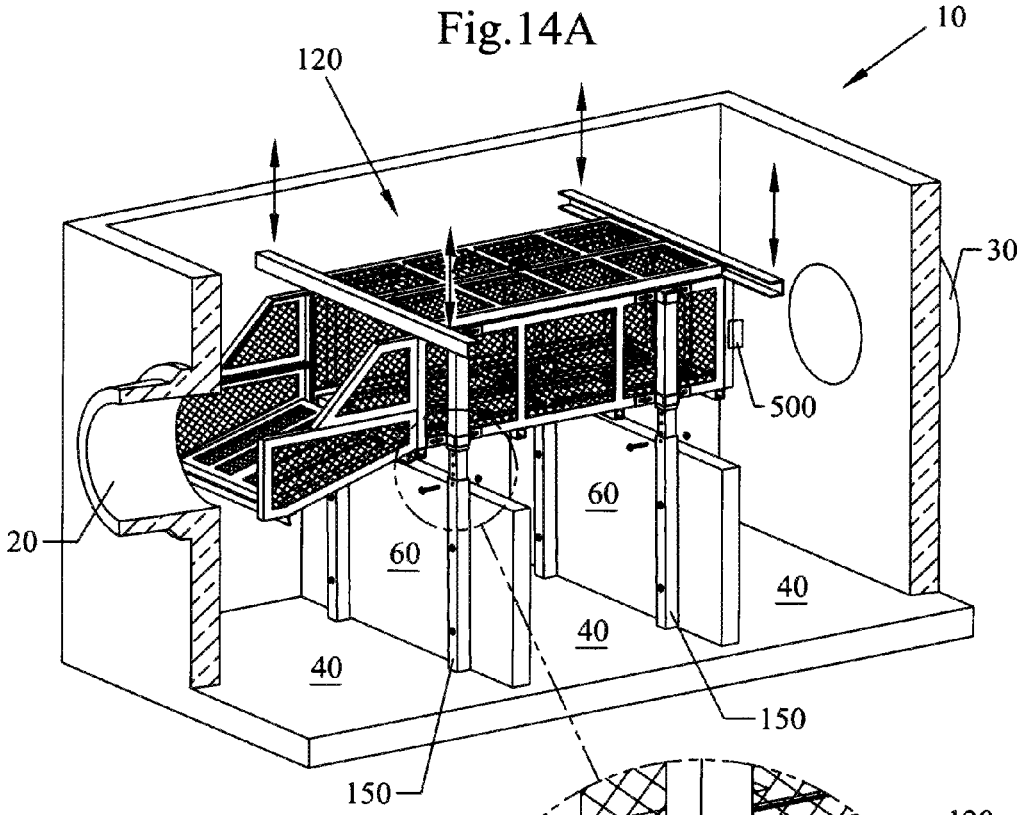
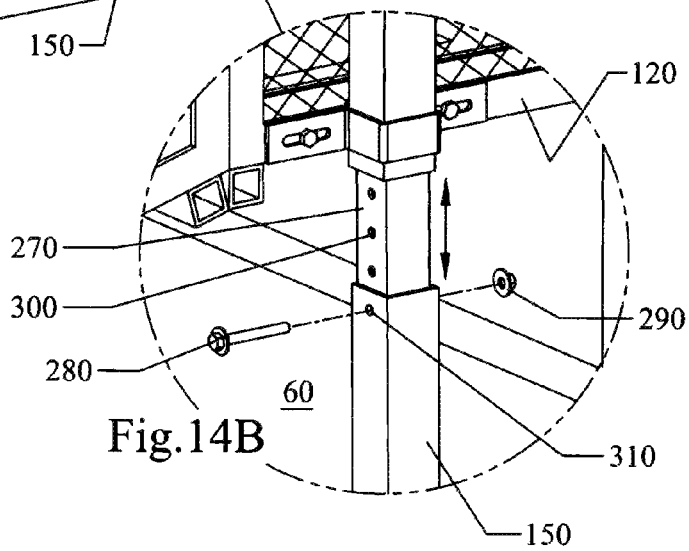
Fig.14B

TELESCOPING POST SUPPORTS AND SLIDING LID SYSTEMS FOR FILTER BASKETS

This invention is a Continuation-In-Part of U.S. patent application Ser. No. 12/292,431 filed Nov. 18, 2008, which claims the benefit of priority on U.S. Provisional Application 61/003,566 filed Nov. 19, 2007, and this invention is a Continuation-In-Part of U.S. patent application Ser. No. 12/315,820 filed Dec. 8, 2008, which claims the benefit of U.S. Provisional Application 61/009,086 filed Dec. 27, 2007.

FIELD OF THE INVENTION

This invention relates to storm water treatment systems, and in particular to devices, apparatus, systems and methods of using an adjustable filter basket on telescoping post supports to raise and lower the filter basket so as to adjust the position of the inlet chute for different ground water levels, and slidable lids on the basket that allow access to the inside of the basket in vaults having ceilings close to the top of the baskets.

BACKGROUND AND PRIOR ART

There are federal clean water requirements that require water bodies such as lakes and rivers must meet strict minimal water quality specifications. To achieve these requirements, stormwater drainage pipes often require treatment before conveying stormwater into receiving water bodies. As a result, a wide variety of technologies have been developed to treat stormwater and improve the water quality. A common variety of stormwater treatment systems are hydrodynamic separators such as baffle type boxes and vortex systems. However, over time stormwater treatment systems often will fill with collected debris and will require service to remove the collected debris. The collected debris often include trash, leaves, grass clippings, sand and gravel, and the like.

U.S. Pat. No. 7,270,747 to Happel et al., which was co-invented by the inventor of the subject invention provided a storm water drain system with a nutrient separating basket having a rigid frame and a plurality of screen sides in the top and bottom and open front end attached to the interior wall edges. An inlet feed chute attached to the open front end allows for directing storm water and debris into the filter basket. The '747 patent has hinged lids on top of the basket that can swing open to access the inside of the basket. However, the swing doors are difficult to open in vaults where the roof of the vault is close in height to the top of the basket. Additionally, the doors are not able to be easily opened and closed if the access opening in the top of the vault is small.

Additionally, filter baskets are normally fixed in position within the vaults, and cannot be adjusted to any different heights without great difficulty. For example, the vaults can fill to different ground level waters and the baskets can be submerged to far below the water level or raised to far above the water level which would impair their operability to both take debris as well as be able to remove debris from the baskets.

In addition, the inventor's previous U.S. patent application Ser. No. 12/292,431 to Happel et al. which is incorporated by reference, requires separate cranks that each have to be rotated to adjust a filter basket in a vault to different ground water levels. The labor and time to move the baskets in place can become both time consuming and expensive.

Thus, the need exists for solutions to the above problems with the prior art.

SUMMARY OF THE INVENTION

A primary objective of the present invention is to provide devices, apparatus, systems and methods of a filter basket system for storm water treatment systems having accessible slidable lid doors for use in vaults having low ceiling heights.

A secondary objective of the present invention is to provide devices, apparatus, systems and methods of a filter basket system for storm water treatment systems having telescopingly adjustable post supports for adjusting the position of the inlet chute for different ground water levels.

A third objective of the present invention is to provide devices, apparatus, systems and methods of a filter basket system for storm water treatment systems having both accessible slidable lid doors and have telescoping posts so as to be adjustably raised and lowered for different ground water levels.

An embodiment of the storm water filter basket for storm water treatment structures, can include a filter basket having a rigid frame with screen sides and a top and a bottom, and a door lid slidably attached across the top of the filter basket having a closed position with the door lid covering the top of the filter basket and an open position where the door lid is slid horizontally exposing substantially all of the top of the basket, wherein the filter basket is installed inside of a storm water treatment structure.

The storm water filter basket further includes a pair of tracks on opposite sides of the door lid for allowing the door lid to slide in a horizontal position, and includes wheels in the tracks for allowing the door lid to slide in the tracks. The door lid can include a pair of door lids, each lid being slid horizontally in an opposite facing direction from one another to move from the closed position to the open position.

The storm water filter basket can include a pair of tracks on opposite sides of each of the door lids for allowing each door lid to slide in a horizontal position, and wheels for allowing each door lid to slide in each of the tracks.

A preferred embodiment of the storm water filter system can include a filter basket having a rigid frame with screen sides and a top and a bottom, a storm water treatment structure, and telescoping members for allowing the filter basket to be adjustably mounted along different vertical heights in the treatment structure.

The telescoping members can include post members extending below each of corner edges of the filter basket and leg members attached to the storm water treatment structure, wherein the post members and leg members are telescopingly received within one another so that the post members are adjustable to different vertical heights in the storm water treatment structure.

The post members can include a plurality of vertical through-holes for allowing the post members to extend to the different vertical heights relative to the leg members. Alternatively, the leg members can include a plurality of a column of vertical through-holes for allowing the post leg members to extend to the different vertical heights relative to the leg members.

A preferred embodiment of the storm water filter system can include a filter basket having a rigid frame with screen sides and a top and a bottom, a door lid slidably attached across the top of the filter basket having an closed position with the door lid covering the top of the filter basket and an open position where the door lid is slid horizontally exposing substantially all of the top of the basket, a storm water treatment structure, and telescoping members for allowing the filter basket to be adjustably mounted along different vertical heights in the treatment structure.

The system can include a pair of tracks on opposite sides of the door lid for allowing the door lid to slide in a horizontal position and wheels in the tracks for allowing the door lid to slide in the tracks. The door lid can include a pair of door lids, each lid being slid horizontally in an opposite facing direction from one another to move from the closed position to the open position. The door lid can include a pair of tracks on opposite sides of each of the door lids for allowing each door lid to slide in a horizontal position and wheels for allowing each door lid to slide in each of the tracks. The telescoping members can include post members extending below each of corner edges of the filter basket and leg members attached to the storm water treatment structure, wherein the post members and leg members are telescopingly received within one another so that the post members are adjustable to different vertical heights in the storm water treatment structure.

The posts can each include a plurality of a column of vertical through-holes for allowing the post to extend to the different vertical heights relative to the leg members. Alternatively, the legs can include a plurality of a column of vertical through-holes for allowing the post to extend to the different vertical heights relative to the leg members.

Further objects and advantages of this invention will be apparent from the following detailed description of the presently preferred embodiments which are illustrated schematically in the accompanying drawings.

BRIEF DESCRIPTION OF THE FIGURES

FIG. 14A is another view of the baffle box of FIG. 13 showing the screen system posts telescopingly mounted to the support legs.

FIG. 14B is enlarged view of one of the screen system posts telescopingly mounted to a support leg.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

2, 4, 6, 8. Side walls of box.
10. Deflector baffle box.
12. Bottom of box
20. Inflow pipe.
30. Outflow pipe.
40. Sediment chambers.
50. Skim boss. Prior art.
60. Baffle.
70. Sediment.
80. Water flow into box.
90. Water flow out of box.
100. Floatable debris.
110A, 110B, 110C. Deflectors.
120. Floatable capturing screen system.
130. Screened containment doors/lids slide in tracks for cleaning floatables from screen system containment chamber.
140. Slide tracks for doors/lids.
150. Screen system support legs bolt to the baffles.
160. Screened door in entry funnel lifts for sediment chamber cleaning access.
170. Containment chamber side screen.
180. Screen system containment chamber.
190. Handle to lift entry funnel door.
200. Handles to slide doors/lids aside for screen system containment chamber cleaning access.
210. Rollers at each end of doors/lids allow easy sliding of doors in tracks.
220. Floatable debris dries when water flow level returns to normal.
230. Water flow level after rain event.
240. Water flow level during medium rain event.
250. Screened doors in containment chamber floor lift for sediment chamber cleaning access.
260. Handles to lift containment chamber doors for sediment chamber access.
270. Mating post slides into support leg and allows vertical adjustment of screen system height inside of vault by means of selecting one of the holes in the post and aligning it with the hole in the support leg then securing the two with a locking bolt and nut.
280. Locking bolt.
290. Locking nut.
300. Adjustment holes in mating post.
310. Locking hole in support post.
400. Single winch lift point,
410. Single cable/line.
420. Corner edge connected cable(s)
500. Floats This invention is a Continuation-In-Part of U.S. patent application Ser. No. 12/292,431 filed Nov. 18, 2008, entitled: Adjustable Filter Basket for a Storm Water Drain System, which claims the benefit of priority on U.S. Provisional Application 61/003,566 filed Nov. 19, 2007, and this invention is a Continuation-In-Part of U.S. patent application Ser. No. 12/315,820 filed Dec. 8, 2008, entitled: Storm Water Filter System Having a Floating Skimmer Apparatus, which claims the benefit of U.S. Provisional Application 61/009,086 filed Dec. 27, 2007, which are all incorporated by reference.

Figure 1:
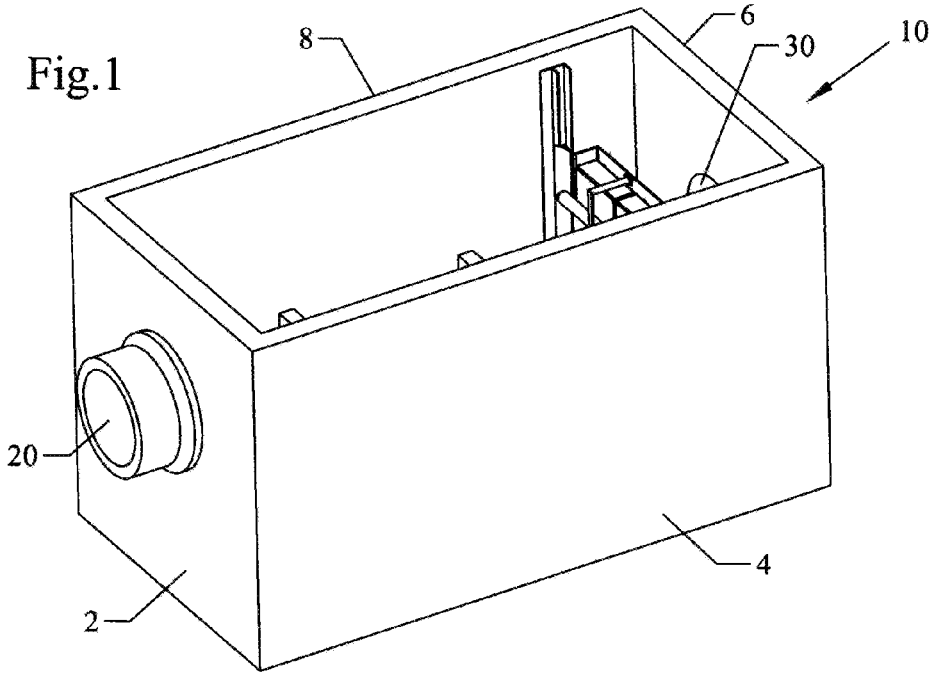
FIG. 1 is a perspective view of a deflector baffle box used in storm water systems.
Figure 2:
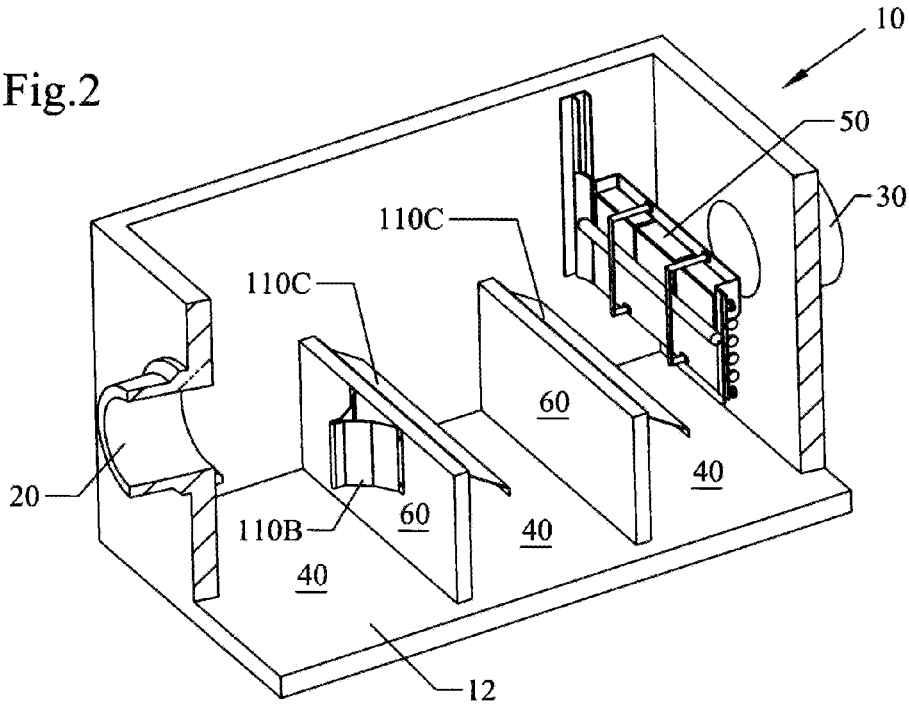
FIG. 2 is a partial cut away view of the deflector baffle box of FIG. 1.
Figure 3:
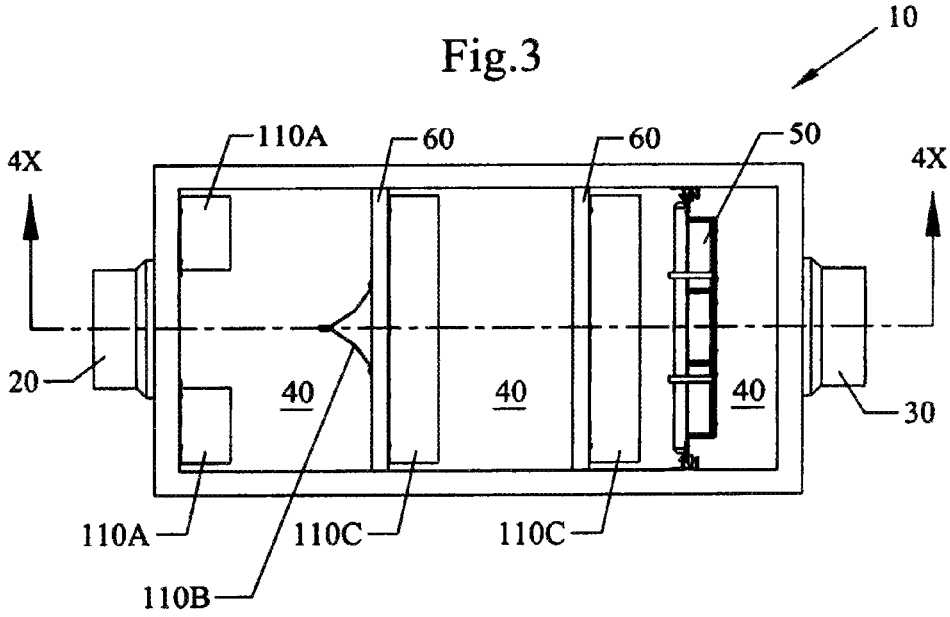
FIG. 3 is a top view of the deflector baffle box of FIG. 1.
Figure 4:
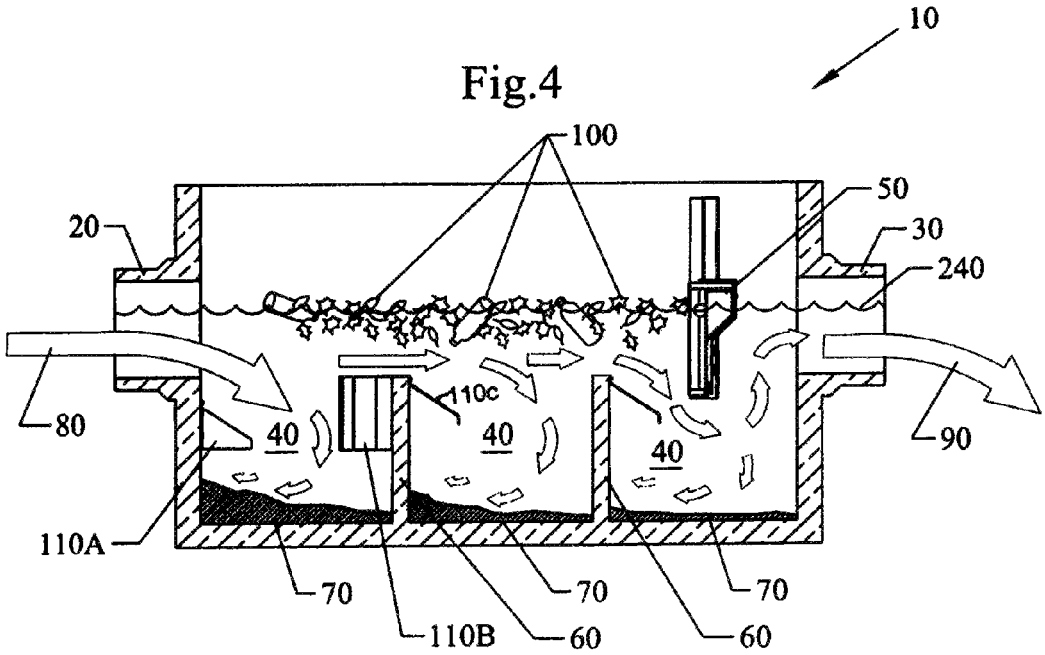
FIG. 4 is a cross-sectional view of the baffle box of FIG. 3 showing water flow through and filtering occurring in the box.

FIG. 1 is a perspective view of a deflector baffle box 10 used in storm water systems. FIG. 2 is a partial cut away view of the deflector baffle box 10 of FIG. 1. FIG. 3 is a top view of the deflector baffle box 10 of FIG. 1. FIG. 4 is a cross-sectional view of the baffle box 10 of FIG. 3 showing water flow through and filtering occurring in the box.

Referring to FIGS. 1-4, a deflector baffle box 10, can have be shaped as a vault with a rectangular shape with side walls 2, 4, 6, 8, and closed bottom 12, and a vault roof (not shown). The external housing of the storm water vault or treatment structure is commonly made of concrete, fiberglass, or plastic.

The baffle box 10 include an inflow pipe 20 in a side wall 2, and an outlet pipe 50 in an opposite side wall 6. Vertically oriented baffles 60 can be mounted in the box 10 and extend above the floor 22. The baffles 60 can separate the box 10 into different sediment chambers 40. Although three chambers are shown, the baffle box 10 can have less or more chambers as needed. In the first chamber 40 can be a set of deflectors 110A, and across a side of one of the baffles 60 can be another type of splitting deflector 110B, and on the other sides of the baffles 60 can be still additional deflectors 110C. Such deflectors 110A, 110B, 110C are shown and used in other baffle boxes by the same inventor as that of the subject application, and control the flow of fluid through the box and allow for sediments 70 to settle to the bottom of the box 10. A skim boss 50 can move up and down to open and block floating debris from passing out of the outflow pipe 30. Such a skim boss 50 can be one such as that shown and described in reference to U.S. patent application Ser. No. 12/315,820 to Happel et al., which is incorporated by reference.

In operation, water 80 from storm water sources and the like, can flow into inflow pipe 20 into first chamber 40 and become deflected by deflector 110B to circulate within the first chamber so that sediment 70 can settle therein. Water can also pass over baffle 60 into the second adjacent chamber 40 and similarly circulate so that sediment 70 settles at the bottom of that chamber 40. Finally, water can also flow over a second baffle 60 into a third chamber 40 and also result in sediment 70 settling therein. Finally, water 90 can pass out of outflow pipe 30. As shown in FIG. 4, the water level 240 allows for floatable debris 100 to be obstructed from passing out of the outflow pipe 30 by the skimmer 50.

Figure 5:
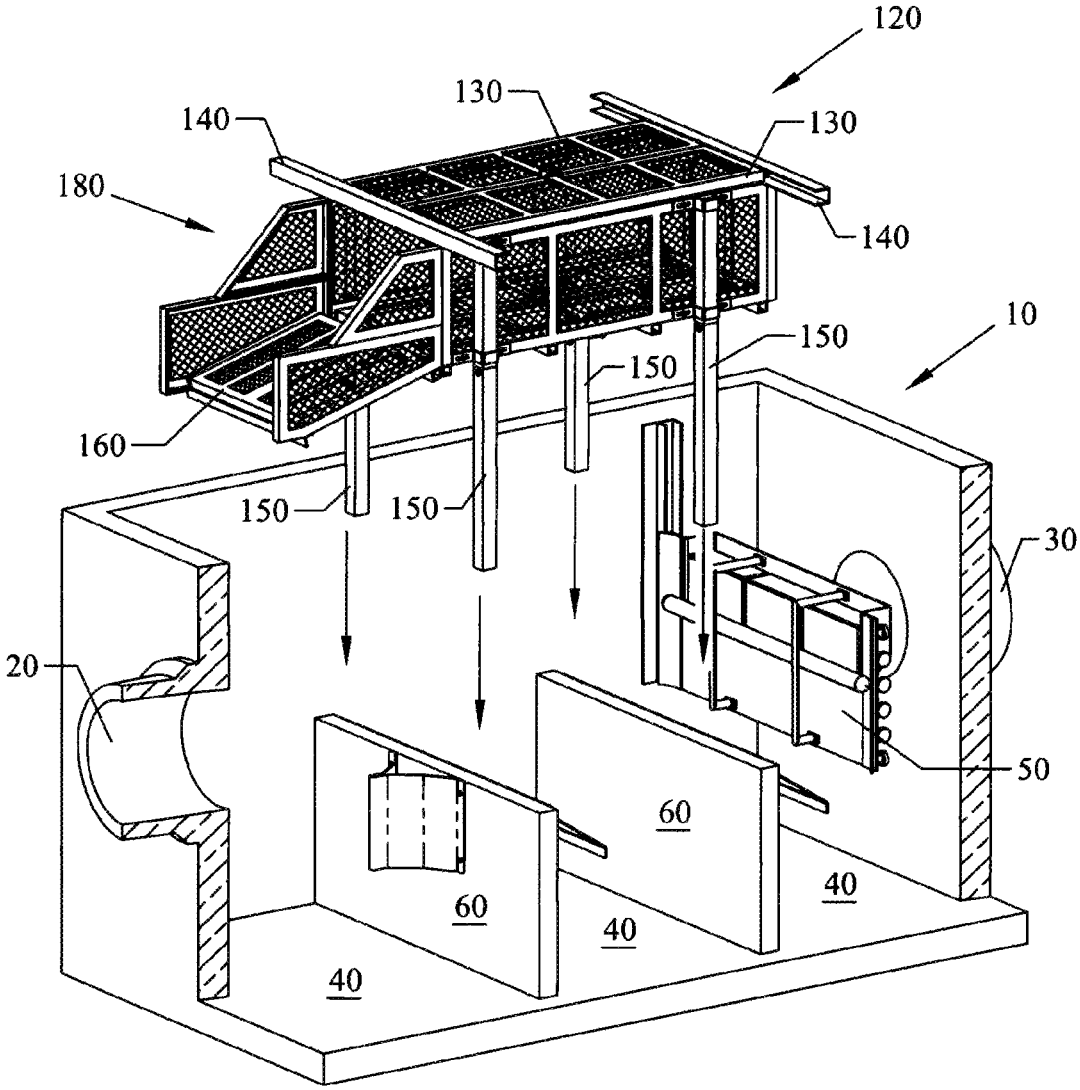
FIG. 5 is another view of the baffle box of FIG. 2 with telescoping screen system ready to be installed.
Figure 6:
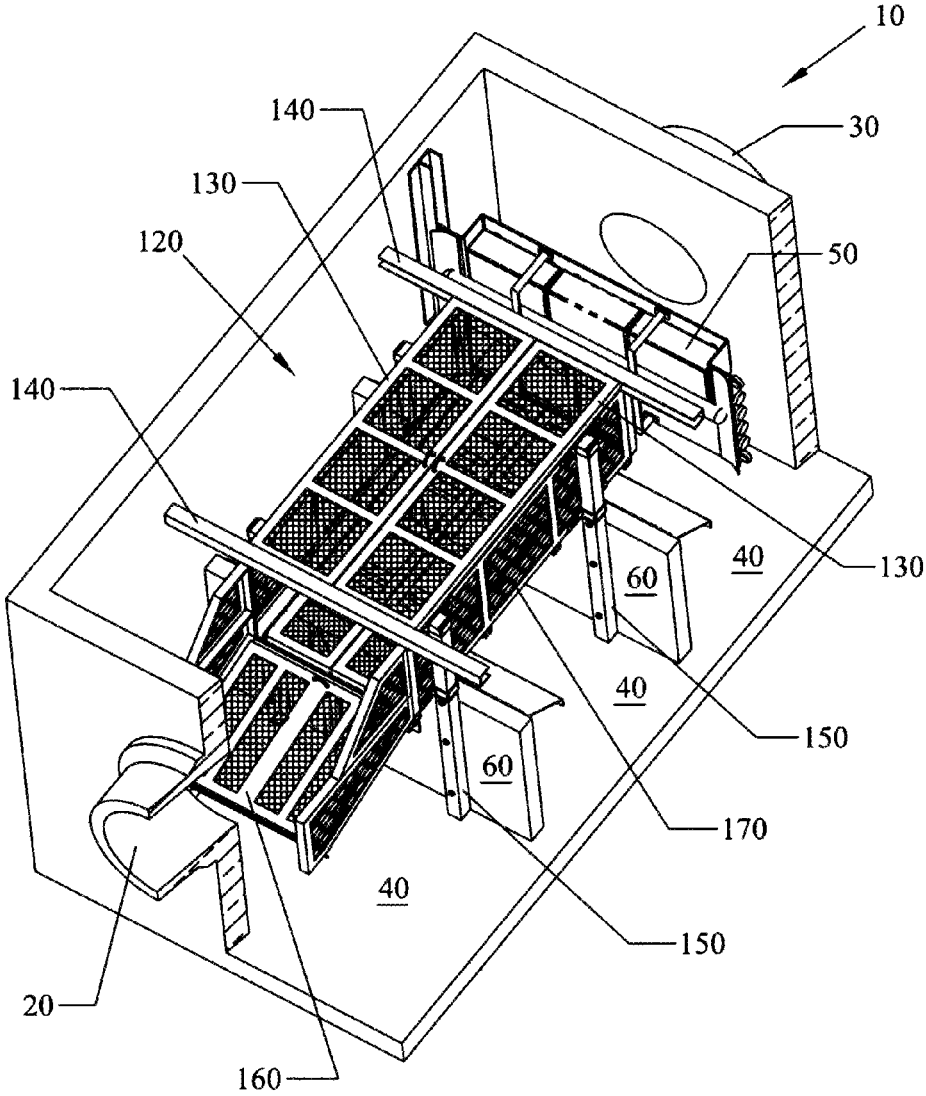
FIG. 6 is a perspective upper view of the baffle box of FIG. 5 with the screen system installed.
Figure 7:
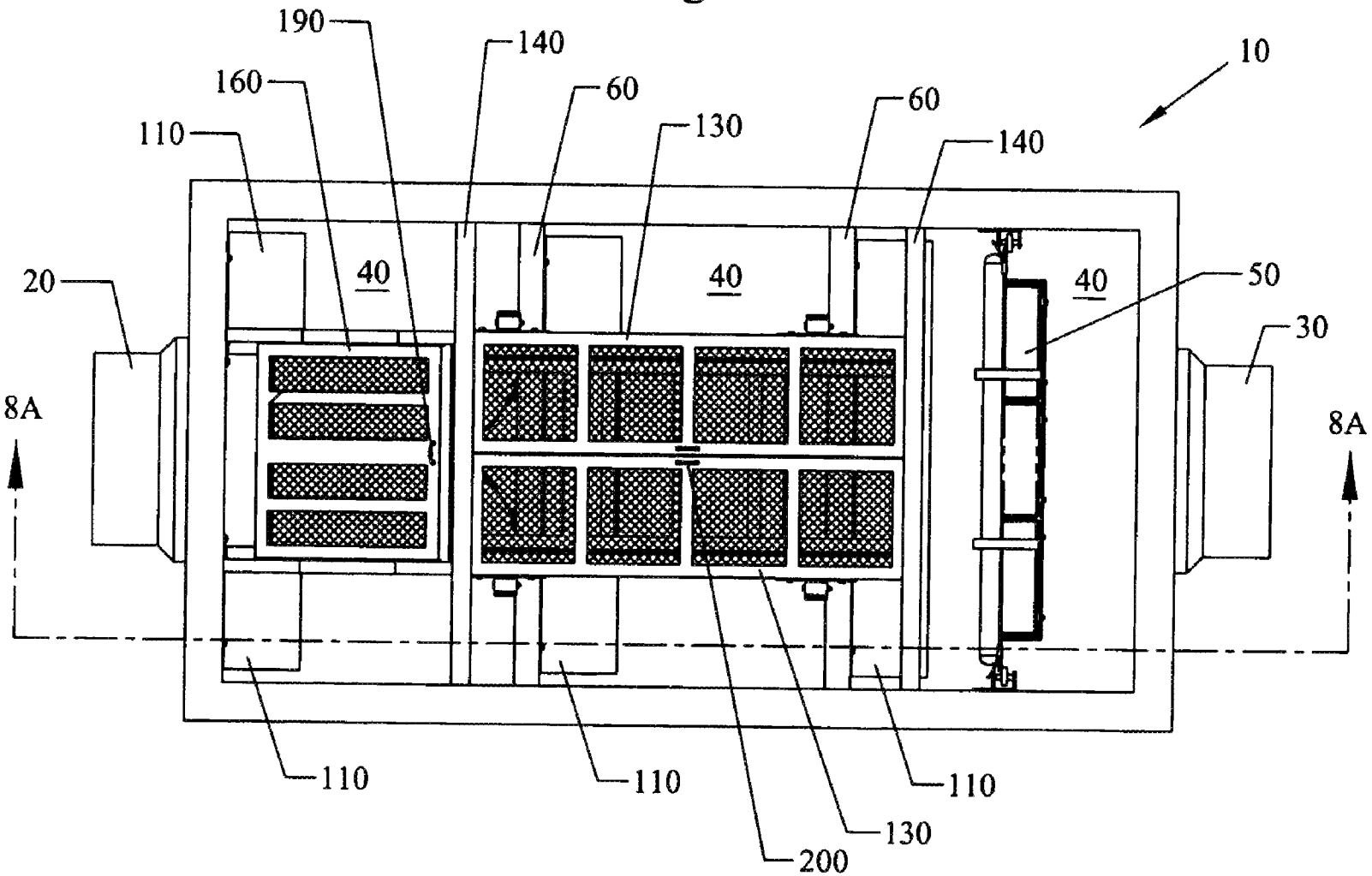
FIG. 7 is a top view of the baffle box of FIG. 6 with the screen system installed.

FIG. 5 is another view of the baffle box 10 of FIG. 2 with telescoping screen system 120 ready to be installed. FIG. 6 is a perspective upper view of the baffle box 10 of FIG. 5 with the screen system 120 installed. FIG. 7 is a top view of the baffle box 10 of FIG. 6 with the screen system 120 installed. The basic components of the screen system containment chamber 180 that includes a screened door 160 in the entry funnel which lifts for sediment chamber cleaning access, the containment chamber side screens 170, handle 190 to lift the entry funnel door, are shown and described in the U.S. Pat. No. 7,270,747 to Happel et al., and U.S. patent application Ser. Nos. 12/792,431 and 12/315,820 both to Happel et al., which are incorporated by reference.

Figures 8A, 8B:
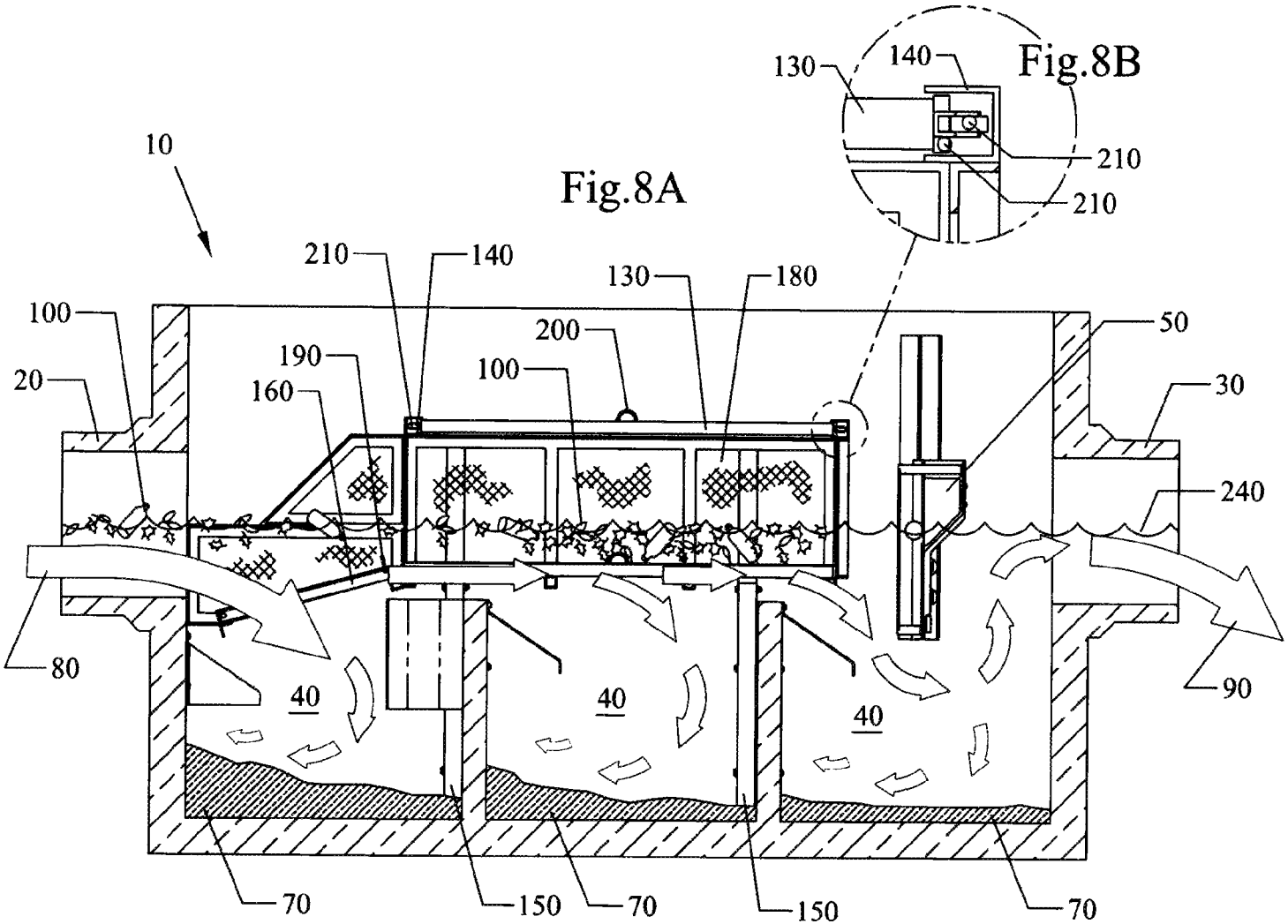
FIG. 8A is a cross-sectional view of the baffle box with screen system of FIG. 7 along arrows 8A showing flow through of water and filtering functions during a rain event.
FIG. 8B is an enlarged view of the sliding tracks for the baffle box lids in FIG. 8A.
Figure 9:
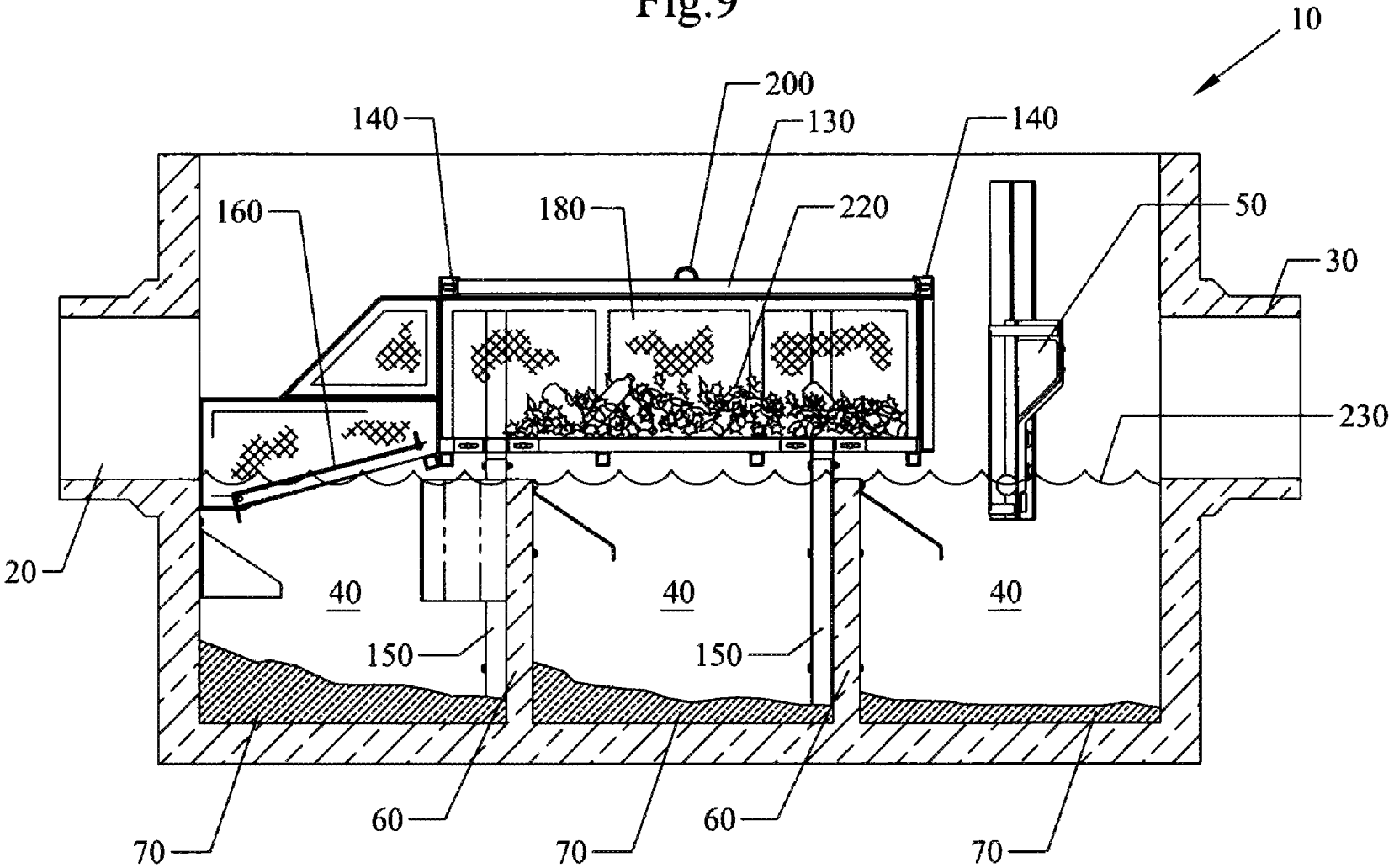
FIG. 9 is another view of the baffle box with screen system of FIG. 8A showing low water level during non-rain period.
Figure 10:
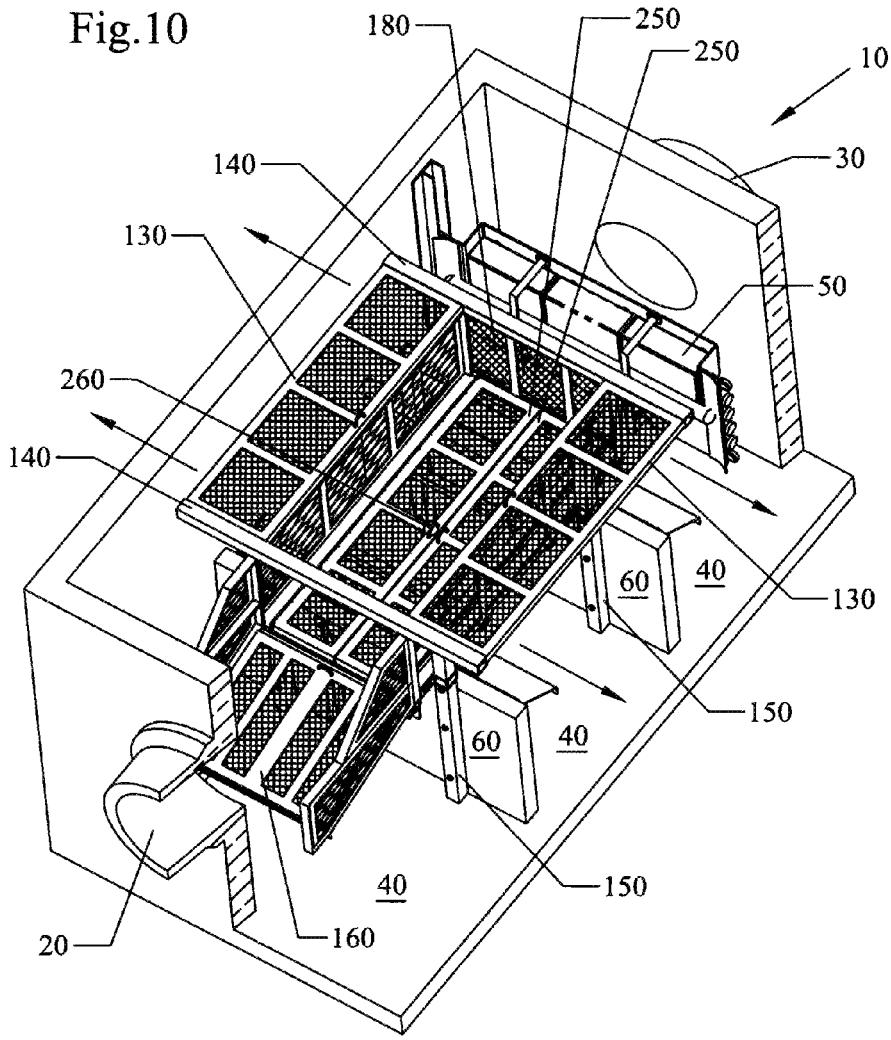
FIG. 10 is another view of the baffle box of FIG. 6 with the sliding lid doors opened to access the debris containment chamber for cleaning.
Figure 11:
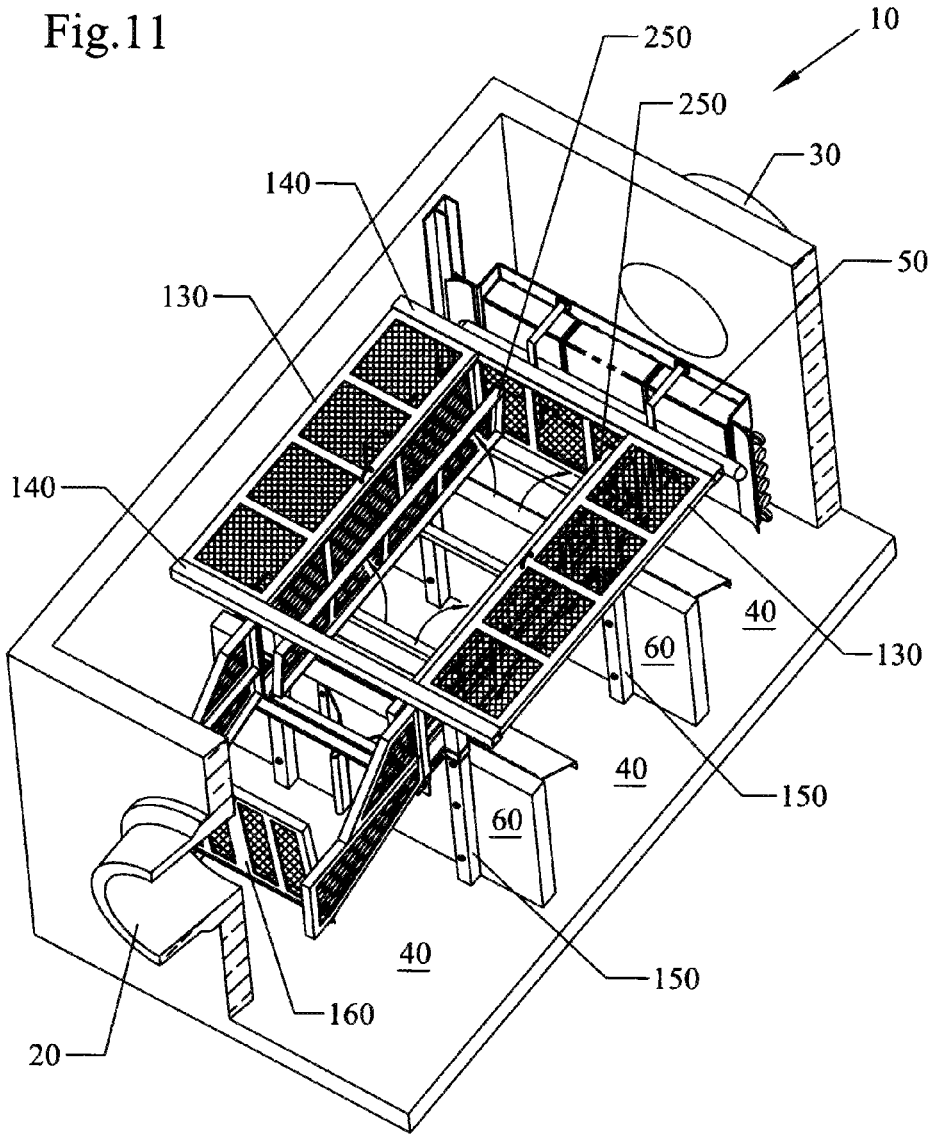
FIG. 11 is another view of the top opened baffle box of FIG. 10, and now with the lower lid doors in the containment chamber flow are open and the door in the entry funnel are open for access to the sediment chambers for cleaning.
Figure 12:
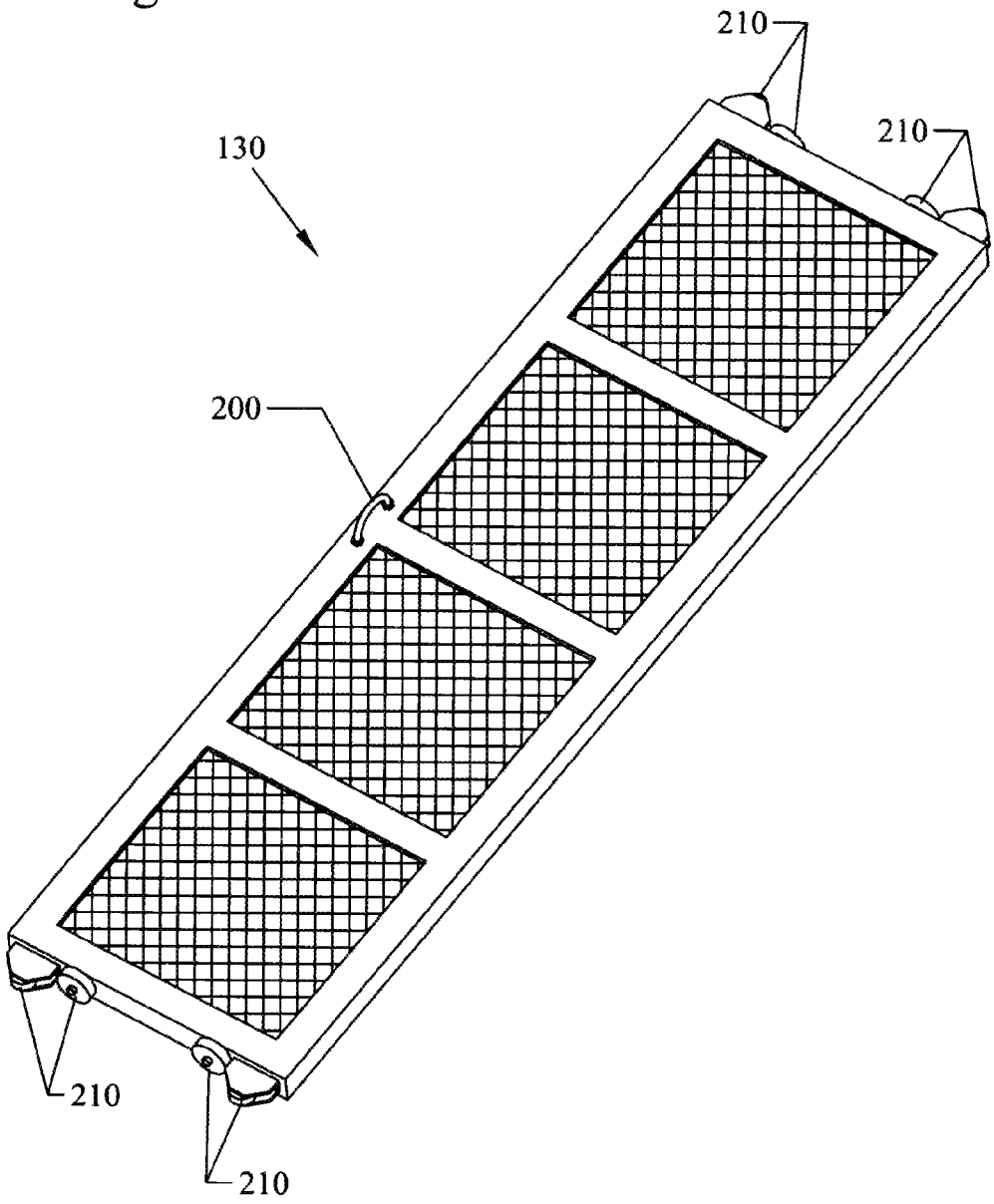
FIG. 12 is a perspective view of a lid door of used in the baffle box of the preceding figures out of its tracks and showing the guide rollers.
Figure 13:
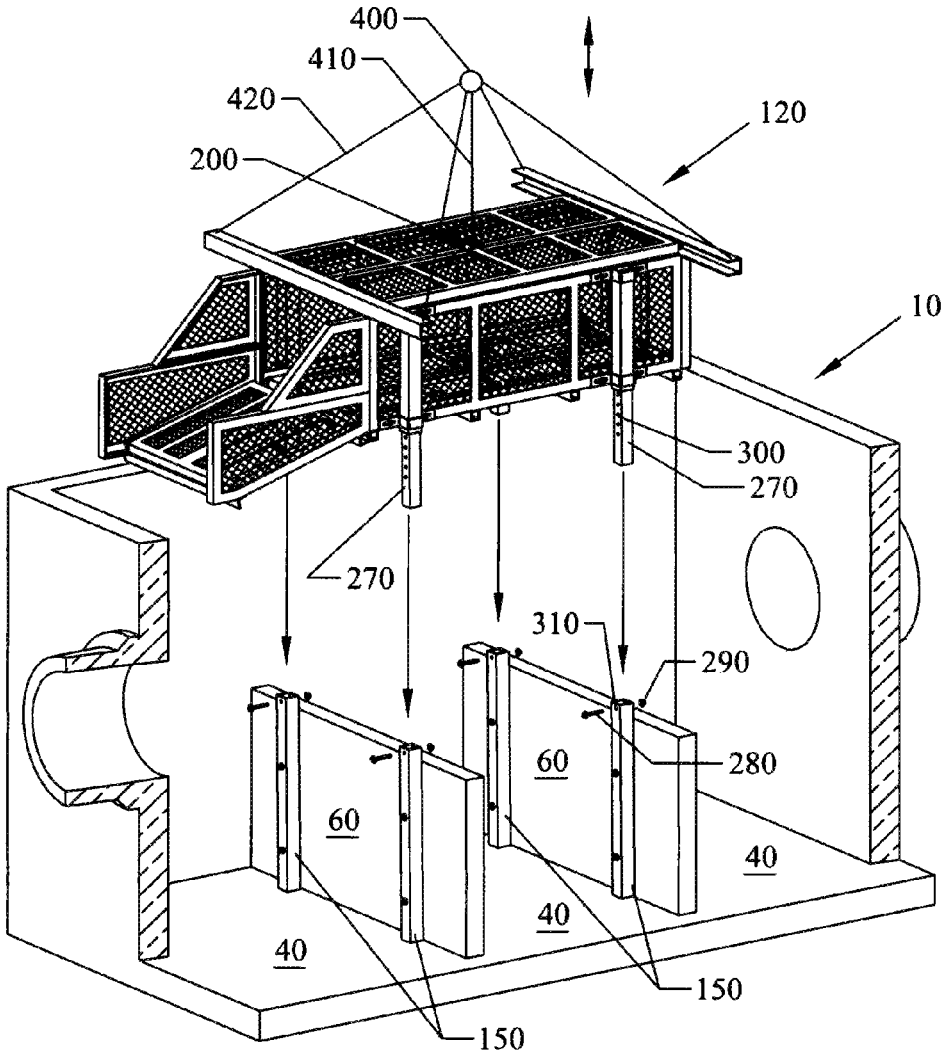
FIG. 13 is another view of the baffle box of FIG. 6 showing the support legs bolted to the baffles with and the screen system with lower extending posts dismounted from the legs.

FIG. 8A is a cross-sectional view of the baffle box 10 with screen system 120 of FIG. 7 along arrows 8A showing flow through of water and filtering functions during a rain event. FIG. 8B is an enlarged view of the sliding tracks 140 for the baffle box lids 130 in FIG. 8A. FIG. 9 is another view of the baffle box 10 with screen system 120 of FIG. 8A showing low water level during non-rain period. The floatables 100 are out of the standing water 230 so they will dry out. FIG. 10 is another view of the baffle box 10 of FIG. 6 with the sliding lid doors 130 opened to access the debris containment chamber 180 inside for cleaning. FIG. 11 is another view of the top opened baffle box of FIG. 10, and now with the lower lid doors 250 in the containment chamber 180 flow are opened by pulling upward on handles 260 and the door 160 in the entry funnel are open for access to the sediment chambers 40 for cleaning. FIG. 12 is a perspective view of a lid door 130 of used in the baffle box 10 of the preceding figures out of its tracks and showing the guide rollers 210. FIG. 13 is another view of the baffle box 10 of FIG. 6 showing the support legs 150 bolted to the baffles 60 with and the screen system 120 with lower extending posts 270 dismounted from the legs 150. FIG. 14A is another view of the baffle box of FIG. 13 showing the screen system posts telescopingly mounted to the support legs. FIG. 14B is enlarged view of one of the screen system posts 270 telescopingly mounted to a support leg 150.

Referring to FIGS. 5-14B, the telescoping posts 270 with support legs 150 will now be described. The floatable capturing screen system 120 can have screen system support legs 150 fixably bolted directly to the sides of the baffles 60. The posts 270 can be part of the four side posts on each of the four corners of the screen system 120. The bottom of the posts 270 can extend beneath the screen system 120, and include a plurality of adjustment holes 300. In operation each bottom of the posts 270 can be inserted into the top opening of each of the hollow legs 150, and fasteners 280 such as locking bolts, screws, and the like, can pass through locking hole(s) 310 in the support posts 150, and into selective ones of the adjustment holes in the mating post 270. A locking nut(s) 290 can lock the fasteners 280 in place. During different usages of the baffle box floating screen system 120, the user allows for the mating posts 270 to slide into the support legs and allows for vertical adjustment of the screen system height inside of the vault of the baffle box 10 by selecting one of the holes 300 in the posts 270 and aligning the posts 270 with the hole 310 in the support legs 150, and then securing the posts to the legs with the locking fastener 280 and nut 290. As shown in FIG. 8A, the telescoping post 270 and leg supports 150 raise and lower the filter basket screen enclosure 120 so as to adjust the position of the inlet chute 160 for different ground water levels 240 so that floatables 100 pass into chute 160.

Although the posts and legs are shown as having a rectangular/square cross-sectional shape, the posts can have other shapes that allow for one to be telescopingly received with each other, such as but not limited to cylindrical shaped, and the like. Although, the figures show the posts 270 being telescopingly received to move up and down into hollow openings in the legs, the invention can be practiced where the posts attached to the screen system are hollow, and the legs pass in and out of the hollow posts.

The location of the fasteners 280 can be located on the upper part of the posts 270 along the side of the screen enclosure 120 and not below the screen enclosure 120, to allow for greater access to attaching and removing the fasteners 280.

The subject invention allows for lifting and lowering the screened enclosure 120 from a single point so that one operator can easily raise and lower the enclosure with the telescopic posts and legs. As previously noted, the inventor's previous U.S. patent application Ser. No. 12/292,431 to Happel et al. requires separate cranks that each have to be rotated to adjust a filter basket to different ground water levels.

Referring to FIG. 13, a single cable/line 410 can be attached to a single winch type lift point 400 and to the centrally located handle(s) 200 or to another location close to the center of gravity of the screen enclosure 120. A single winch can lift raise and lower the entire screen enclosure 120 from a single winch connection point 400 so the posts 270 are telescopingly moved to different lengths relative to the legs 150. Alternatively, plural cables/lines 430 can be attached to each of the four corners of the enclosure 120, which are attached to the single winch lifting point 400.

Although the invention can be practiced with a lifting type winch, the invention can allow for floats 500 FIG. 14A such as rotomold cast floats that can be attached along or around each of the side walls of the screened enclosure 120. The floats 500 can allow the enclosure to raise and lower automatically depending on the water level. Fasteners 280 would not have to be used so that the enclosure is free floating along the telescopic posts/legs depending upon surrounding water levels.

Referring to FIGS. 5-14B, the sliding screened containment doors/lids 130 will now be described. The sliding doors/lids are used to cover the top opening to the screen system containment chamber 180, and can include two doors/lids 130 each with upwardly extending handles 200, with the ends of the doors/lids 130 having both horizontal and vertically oriented rollers/wheels 210, which are mounted on tracks 140. Handles 200 on each of the sliding doors/lids 130 can be gripped by users to allow the doors/lids 130 to slide in opposite directions from one another to allow access into the screen system containment chamber 180. The sliding doors/lids 130 can be extremely useful in vaults having low ceilings. The vertical and horizontally oriented rollers 210 on the ends of the doors/lids 130 allow for the doors/lids 130 to be easily slid along the tracks 140 with little effort needed.

The doors/lids 130 can slide in tracks with or without rollers/wheels 210. The rollers/wheels can be attached inside of the tracks instead of at the ends of the doors/lids 130. Alternatively, some rollers/wheels can be attached inside of the tracks while some wheels are attached to the ends of the doors/lids 130.

Although the drawings show two doors/lids 130, the embodiment can be practiced with a single door/lid or a plurality of sliding doors/lids. For example, the invention can have four sliding doors/lids on top of the enclosure.

Additionally, the lower screened doors 250 in the containment chamber 180 can also be used with horizontal sliding doors/lids 130. Also, the posts/legs can be moved to the corners of the enclosure to allow for the lower doors/lids in the enclosure have room to slide in place.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A storm water treatment system comprising:

a below grade treatment chamber having an inlet;

a filter system positioned within said treatment chamber to receive liquid entering said chamber through said inlet, said filter system including:

a filter basket having a rigid frame with screen sides and a top and a bottom;

an openable door lid attached across the top of the filter basket having a closed position with the door lid covering the top of the filter basket and an open position; and a plurality of post members extending below bottom edges of the filter basket, and a plurality of leg members attached to said chamber, wherein the post members and leg members are telescopingly received within one another so that the post members are adjustable to different vertical heights in the chamber, thereby allowing the filter basket to be vertically mounted along different vertical heights of said treatment chamber.

2. A storm water treatment system comprising:

a below grade treatment chamber having an inlet;

a filter system positioned within said treatment chamber to receive liquid entering said chamber through said inlet, said filter system including:

a filter basket having a rigid frame with screen sides and a top and a bottom;

an openable door lid attached across the top of the filter basket having a closed position with the door lid covering the top of the filter basket and an open position; and telescoping post members extending below each of corner edges of the filter basket, and leg members attached to said chamber, wherein the post members and leg members are telescopingly received within one another so that the post members are adjustable to different vertical heights in the chamber, thereby allowing the filter basket to be vertically mounted along different vertical heights of said treatment chamber.

3. A storm water treatment system comprising:

a below grade treatment chamber having an inlet;

a filter system positioned within said treatment chamber to receive liquid entering said chamber through said inlet, said filter system including:

a filter basket having a rigid frame with screen sides and a top and a bottom;

a door lid slidably attached across the top of the filter basket having a closed position with the door lid covering the top of the filter basket and an open position where the door lid is slid horizontally exposing substantially all of the top of the basket; and telescoping members for allowing the filter basket to be adjustably mounted along different vertical heights in said treatment chamber.

4. The stormwater treatment system of claim 3, further comprising:

a pair of tracks on opposite sides of the door lid for allowing the door lid to slide in a horizontal position.

5. The stormwater treatment system of claim 4, further comprising:

wheels in the tracks for allowing the door lid to slide in the tracks.

6. The stormwater treatment system of claim 3, wherein the door lid includes a pair of door lids, each lid being slid horizontally in an opposite facing direction from one another to move from the closed position to the open position.

7. The stormwater treatment system of claim 6, further comprising: a pair of tracks on opposite sides of each of the door lids for allowing each door lid to slide in a horizontal position.

8. The stormwater treatment system of claim 3, further comprising:

wheels for allowing each door lid to slide in each of the tracks.

9. The stormwater treatment system of claim 3, wherein the telescoping members include: post members extending below bottom edges of the filter basket; and leg members attached to said treatment chamber, wherein the post members and leg members are telescopingly received within one another so that the post members are adjustable to different vertical heights within the treatment chamber.

10. The stormwater treatment system of claim 9, wherein the post members include: a plurality of a column of through-holes for allowing the post members to extend to the different vertical heights relative to the leg members.

11. The stormwater treatment system of claim 9, wherein the leg members include: a plurality of a column of through-holes for allowing the post members to extend to the different vertical heights relative to the leg members.

* * * * *